US005204139A

United States Patent [19]

Choi

[11] Patent Number: 5,204,139

[45] Date of Patent: Apr. 20, 1993

[54] METHOD FOR COATING THERMIONIC EMISSION MATERIAL FOR A THERMIONIC EMISSION FILAMENT

[75] Inventor: Kyeong-seok Choi, Ulsan, Rep. of Korea

[73] Assignee: Samsung Electron Devices Co., Ltd., Kyunggi, Rep. of Korea

[21] Appl. No.: 785,108

[22] Filed: Oct. 30, 1991

[30] Foreign Application Priority Data

Nov. 2, 1990 [KR] Rep. of Korea ..... 90-17769

[51] Int. Cl.[5] ..... B05D 5/12

[52] U.S. Cl. ..... 427/77; 427/117; 427/120; 427/178; 427/240; 427/372.2; 427/434.6; 427/434.7; 427/435

[58] Field of Search ..... 427/77, 117, 120, 240, 427/178, 372.2, 434.6, 434.7, 435

[56] References Cited

U.S. PATENT DOCUMENTS

| | | | |
|---|---|---|---|
| 4,251,569 | 2/1981 | Mager et al. | 427/77 |
| 4,411,710 | 10/1983 | Mochizuki et al. | 427/434.7 |
| 4,436,762 | 3/1984 | Metz | 427/117 |
| 4,836,816 | 6/1989 | Bouchard | 427/77 |

*Primary Examiner*—Janyce Bell
*Attorney, Agent, or Firm*—Leydig, Voit & Mayer

[57] ABSTRACT

Disclosed is a thermionic emission material coating method for a filament used in a fluorescent display tube. The tungsten wire emerges in a carbonate oxide thermionic emission material in dryable form while rotating it so that the carbonate oxide becomes coated on the circumference of the wire and then dries the tungsten wire while rotating it to have a uniform thickness of coating over its entire circumference, thereby preventing flaking off the thermionic emission material and filament breakage which is caused by the uneven coating of thermionic emission material.

3 Claims, 2 Drawing Sheets

METHOD FOR COATING THERMIONIC EMISSION MATERIAL FOR A THERMIONIC EMISSION FILAMENT

BACKGROUND OF THE INVENTION

The present invention relates to a method for coating thermionic emission material for a thermionic emission filament, and particularly to a method for coating thermionic emission material for a thermionic emission filament used in a fluorescent tube.

The conventional filament used in a fluorescent tube is coated with a carbonate oxide of the electron emission material on tungsten wire and is made to emit thermions from the carbonate oxide coating on the tungsten wire due to the generation of heat in the tungsten wire.

In FIG. 1, the coating device is illustrated which exemplifies conventional thermionic emission material coating method for coating carbonate oxide onto a tungsten wire filament.

A conventional carbonate oxide coating device has a carbonate oxide storage tank 6, a supply roller 3 which supplies the tungsten wire used for the filament material and a take up roller 4 which reels up the tungsten wire from supply roller 3 between tank 6 and supply roller 3, there is provided a back tension regulation means 5 which regulates back tension applied to the tungsten wire 31 being reeled onto take-up roller 4. Also, between tank 6 and lake up roller 4 there is provided a drying means to dry the carbonate oxide coated to the tungsten wire.

In such a conventional thermionic emission material coating device, the supply roller 3 is installed to a fixed rotating axle so that it can passively rotate by a tension applied on the tungsten wire. The take-up roller 4 is installed so that rotation is actuated by an accompanying rotation device used to take-up the tungsten wire. Back tension regulation means 5 is a pair of rubber rollers of which number of rotations is regulated in accordance with the tensile strength of the tungsten wire 31. A electric heater is used as drying means 7. Furthermore, the tank 6, which contains dryable carbonate oxide, must be designed to enable immersion of the tungsten wire 31 supplied from supply roller 3 in the carbonate oxide.

Carbonate oxide coating through such a conventional carbonate oxide coating device 1 is processed as follows. The tungsten wire 31 from the supply roller 3 sequentially passes through back tension regulation means 5, dryable carbonate oxide storage tank 6 and drying means 7 when take-up roller 4 rotates.

During such sequential conveyance process, the tungsten wire is coated with carbonate oxide and dried in such a state that a certain tension is applied by the back tension regulation means 5, and finally wound onto the take-up reel 4.

According to this conventional method, since the carbonate oxide coating and drying thereof on the tungsten wire 31 are performed between supply roller 3 which is fixedly positioned and take-up roller 4, the carbonate oxide coating on tungsten wire 31 is not of uniform thickness around the circumference surface of the tungsten wire as shown in FIGS. 2A and 2B.

This non-uniformity of the carbonate oxide coating thickness is caused by running down of the carbonate oxide from the tungsten wire surface due to its weight before drying and after being coated on the tungsten wire during the carbonate oxide coating process. Since the electrical load on the tungsten wire 31 is not applied uniformly from an electric source due to the non-uniform thickness of the carbonate oxide, the carbonate oxide layer coating on the circumference of the tungsten wire peels or flakes off or even breaks.

SUMMARY OF THE INVENTION

It is an object of the present invention to provide a thermionic emission material coating method for a thermionic emission filament so as to be able to form a uniform carbonate oxide layer onto the circumference surface of the tungsten wire.

In order to achieve the above object of the present invention, there is provided a method for coating thermionic emission material onto a tungsten wire so that the tungsten wire passes through a thermionic emission material storage tank and then the thermionic emission material coated on the tungsten wire is dried, wherein the tungsten wire centrally rotates about a central axis in the conveyed direction within the tank and while passing through the lank, the thermionic emission material is uniformly coated onto the circumference outer surface of the tungsten wire.

DETAILED DESCRIPTION OF THE PREFERRED EMBODIMENT

Figure 1:
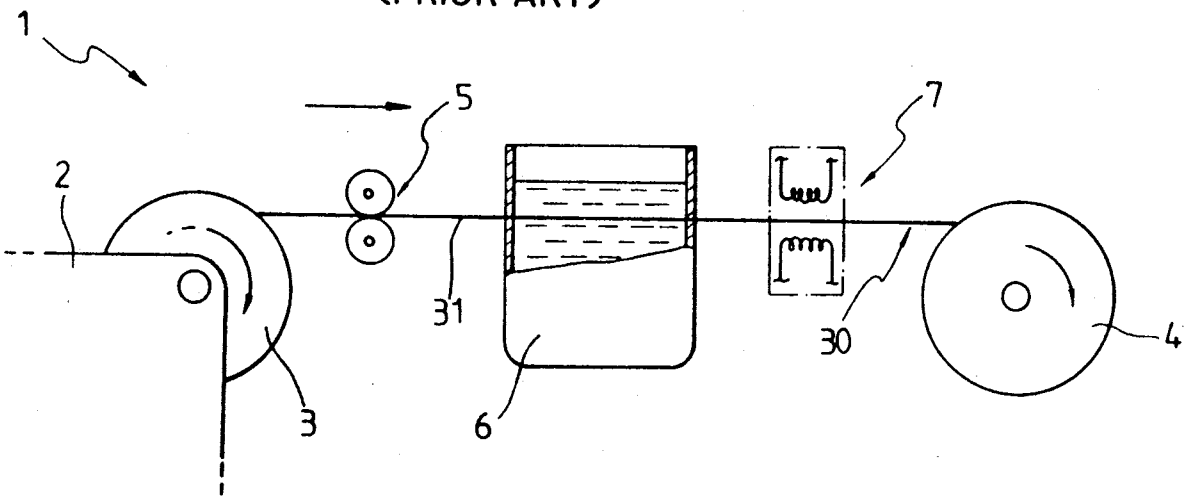
FIG. 1 (PRIOR ART)
FIG. 1 is a schematic diagram of a conventional thermionic emission material coating device for coating a carbonate oxide onto a tungsten wire.
Figure 2B:
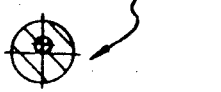
FIG.2B (PRIOR ART)
FIGS. 2A and 2B are a partially sectionalized plan view and a front sectionalized view of the filaments coated with the thermionic emission material in accordance with a conventional method, respectively.
Figure 2A:
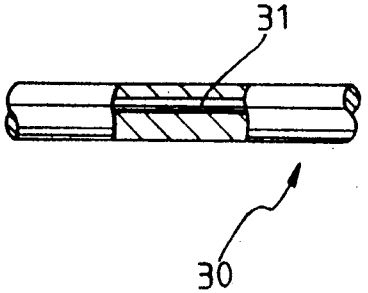
Figure 3:
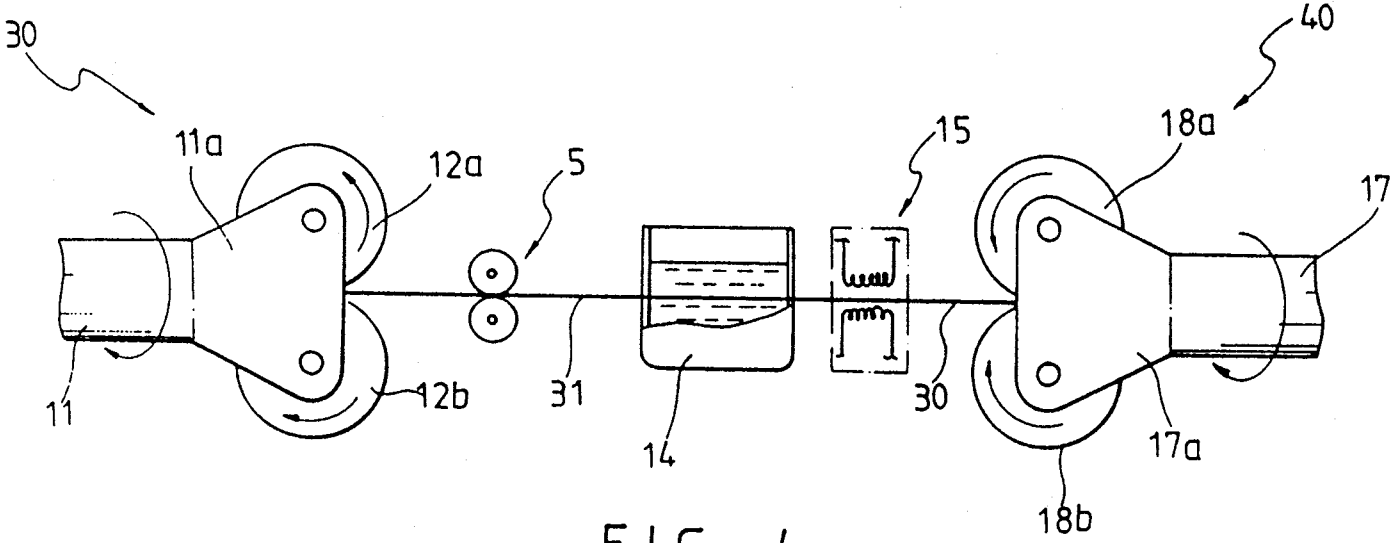
FIG. 3 is a schematic diagram of a basic thermionic emission material coating device for executing the thermionic emission material coating method for the filament according to the present invention.

In FIG. 3, a thermionic emission material coating device adapted to perform a carbonate oxide coating method for a filament according to the present invention is illustrated.

This coating device has a storage tank 14 for storing a dryable carbonate oxide, a supply section 30 that supplies the tungsten wire of filament material and a take-up reel section 40 for taking up the tungsten wire from the supply section. Between supply section 30 and storage tank 14 there is provided a back tension regulating means 5 that regulates back tension by applying a certain strength to the tungsten wire 31 being reeled onto take up section 40, and between tank 14 and take-up section 40 there is provided a dryer section 15 for drying the carbonate oxide coated onto the tungsten wire.

In this coating device, the supply section 30 comprises a first revolving axle 11 which rotates in the horizontal plane, and a supply roller **12*a* and a guide roller 12*b* that are fixed on an upper and lower part of a bracket 11*a* provided at the edge of the first revolving axle. The tungsten wire, being the object to be coated is reeled on supply roller 12*a* and the guide roller 12*b* is positioned to be in contact with the supply roller 12*a* to aid the smooth conveyance of the tungsten wire unwound from the supply roller 12***a*. The supply roller 12*a* and guide roller 12*b* are positioned so that the tungsten wire 31 being drawn out through a section where the two rollers are in contact can be placed at the center of rotation of the first revolving axle 11. The rollers 12*a* and 12*b* are fixed to bracket 11*a* to rotate passively on their axles by the tensile strength being applied to the tungsten wire.

In addition, take-up section 40 has a second revolving axle 17 placed on the same axis as first revolving axle 11, and a take-up roller 18*a* and a guide roller 18*b* that are fixed on the upper and lower parts of bracket 17*a* at the edge of a second revolving axle 17 positioned as a counterpart to bracket 11*a* of the first revolving axle 11. The take up roller 18*a* is installed to be able to rotate actively by a rotation device, not shown in the drawings, so that the tungsten wire can be rolled up from supply roller 12*a*. Here, the rotation device desirably adopts a simple geared motor to rotate the supply roller 12*a* only and more desirably contains a means for changing speed to possibly control of the speed.

Additionally, according to the present invention, a first revolving axle 11 and a second revolving axle 17 are installed so that they rotate with separate rotation devices and the conveyance direction center of the tungsten wire between the two axles is made to the center axis of rotation to rotate in the same direction and to revolve in one direction while the tungsten wire is being conveyed from the supply section to the take-up section.

The back tension regulation means 5 is so desirably constructed as to have a pair of supply rollers that can regulate to apply a certain conveyance control strength on the tungsten wire in accordance with the tensile strength of the tungsten wire 31 as being the conventional case and the dryer means 15 desirably uses an electric heater. Additionally, the tank 14 containing the dryable carbonate oxide must be designed so that the tungsten wire 31 being supplied from supply section 30 and conveyed to a take-up section 40 can be immersed in the carbonate oxide.

An explanation of the carbonate oxide coating method according to the present invention follows with reference to such coating device described above.

First, in order to coat a carbonate oxide onto the circumferential surface of the tungsten wire 31, the take-up roller 18*a* of take up section 40 is rotated in a specified number of rotations while first revolving axle 11 and second revolving axle 17 are first rotated simultaneously in the same direction by the rotation means. In doing so, tungsten wire 31 reels out to pass between supply roller 12*a* and guide roller 12*b* on one central axis of rotation of a first revolving axle and second revolving axle while unwinding from supply roller 12*a*. Then, the back tension regulating means 5 conveys the tungsten wire 31 passing through the carbonate oxide storage tank 14 with a consistent tension because it applies a certain strength on the tungsten wire 31. After the tungsten wire 31 passes through tank 14, it passes through a dryer means 15 where heat is applied and by doing this, the surface where the carbonate oxide has been applied is dried. The dried tungsten wire 31 is wound on roller 18*a* after entering between guide roller 18*b* and take-up roller 18*a*.

Figure 4:
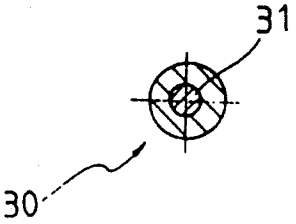
FIG. 4 is a section view of a filament that is coated with a thermionic emission material in accordance with the present invention.

In such a process, the carbonate oxide is coated onto the circumference surface of the tungsten wire 31 by immersing the tungsten wire 31 supplied from supply roller 12*a* into the dryable carbonate oxide stored in the tank 14 and then the tungsten wire 31 becomes uniformly coated with carbonate oxide onto its surface by rotating on a central axis in the conveyed direction. The tungsten wire coated with the carbonate oxide on its circumference surface in this manner is dried by passing it through dryer means 15 and the tungsten wire 31 forms a uniform coating on its circumference surface as illustrated in FIG. 4 by continually rotating even during drying.

The thermionic emission material coating method for coating a filament according to the present invention prevents the partial overload of the filament coating due to non-uniformity of the carbonate oxide layer thickness by coating and drying the carbonate oxide while rotating the tungsten wire thereby enabling prevention of flaking off of the coated layer or filament breakage.

What is claimed is:

1. A method for coating a thermionic emission material on a thermionic emission filament wherein tungsten wire is conveyed in a conveyance direction and passed through a storage tank containing a dryable thermionic emission material and then the thermionic emission material is dried after being coated onto the tungsten wire, said tungsten wire being made to rotate around a central axis of a conveyance direction to uniformly coat the thermionic emission material onto the surface of the tungsten wire.

2. A method for manufacturing a thermionic emission filament by coating a thermionic emission material on a tungsten wire comprising the steps of:

coating said tungsten wire with thermionic emission material by passing said tungsten wire through a storage tank containing a dryable thermionic emission material;

drying said thermionic emission material after said coating step; and rotating said tungsten wire around a central axis of a conveyance direction while performing said coating and drying steps to uniformly coat said thermionic emission material onto a circumference surface of said tungsten wire thereby.

3. A method for coating a material on a wire comprising the steps of:

coating said wire with a dryable material by passing said wire through a storage tank containing said dryable material;

drying said material; and rotating said wire around a central axis of a conveyance direction while performing said coating and drying steps to uniformly coat said material onto a circumference surface of said wire thereby.

* * * * *